US009539696B2

(12) United States Patent
Fukushima et al.

(10) Patent No.: US 9,539,696 B2
(45) Date of Patent: Jan. 10, 2017

(54) RETAINER RING, POLISH APPARATUS, AND POLISH METHOD

(71) Applicant: KABUSHIKI KAISHA TOSHIBA, Minato-ku (JP)

(72) Inventors: Dai Fukushima, Kuwana (JP); Takashi Watanabe, Yokkaichi (JP); Jun Takayasu, Yokkaichi (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 0 days.

(21) Appl. No.: 14/578,845

(22) Filed: Dec. 22, 2014

(65) Prior Publication Data

US 2015/0183082 A1 Jul. 2, 2015

(30) Foreign Application Priority Data

Dec. 26, 2013 (JP) ..... 2013-269506

(51) Int. Cl.
*B24B 37/32* (2012.01)
*B24B 37/10* (2012.01)
*B24B 37/04* (2012.01)

(52) U.S. Cl.
CPC ..... *B24B 37/32* (2013.01); *B24B 37/042* (2013.01); *B24B 37/10* (2013.01); *B24B 37/107* (2013.01)

(58) Field of Classification Search
CPC ..... B24B 37/32; B24B 37/042; B24B 37/107
See application file for complete search history.

(56) References Cited

U.S. PATENT DOCUMENTS 5,944,590 A 8/1999 Isobe et al.
5,944,593 A * 8/1999 Chiu ..... B24B 37/042 451/288
6,183,350 B1 * 2/2001 Lin ..... B24B 37/042 451/285
6,893,327 B2 * 5/2005 Kajiwara ..... B24B 37/32 451/285
7,722,439 B2 5/2010 Torii
8,393,936 B2 3/2013 Wang
(Continued)

FOREIGN PATENT DOCUMENTS

JP 11-333712 12/1999
JP 3129172 1/2001
(Continued)

*Primary Examiner* — Dung Van Nguyen
(74) *Attorney, Agent, or Firm* — Oblon, McClelland, Maier & Neustadt, L.L.P.

(57) ABSTRACT

A retainer ring configured to be attachable, at a first side thereof, to a polish head of a polish apparatus configured to polish a polish object by depressing the polish object against a polish pad is disclosed. The retainer ring is configured to depress the polish pad at a second side thereof. The retainer ring includes a contact surface contacting the polish pad. The contact surface applies depressing force on the polish pad. The depressing force is directed from a polish head side and is applied so as to be centered on an imaginary circle of pressure center having a radius falling substantially in a middle of an inner radius of the retainer ring and an outer radius of the retainer ring. An area of the contact surface is greater in a first region inside the circle of pressure center than in a second region outside the circle of pressure center.

8 Claims, 14 Drawing Sheets

(56) References Cited

U.S. PATENT DOCUMENTS

2006/0046621 A1* 3/2006 Phang ..... B24B 37/32
451/41

FOREIGN PATENT DOCUMENTS

| | | |
|---|---|---|
| JP | 2007-27166 | 2/2007 |
| JP | 3937294 | 6/2007 |
| JP | 2008-307674 | 12/2008 |
| JP | 2009-50943 | 3/2009 |
| JP | 2009-224680 | 10/2009 |
| JP | 2010-129863 | 6/2010 |
| JP | 4534165 | 9/2010 |
| JP | 2011-83836 | 4/2011 |

* cited by examiner

RETAINER RING, POLISH APPARATUS, AND POLISH METHOD

CROSS-REFERENCE TO RELATED APPLICATION(S)

This application is based upon and claims the benefit of priority from Japanese Patent Application No. 2013-269506, filed on, Dec. 26, 2013 the entire contents of which are incorporated herein by reference.

FIELD

Embodiments disclosed herein generally relate to a retainer ring, a polish apparatus and a polish method.

BACKGROUND

One example of a polish apparatus for polishing objects such as a semiconductor wafer is a CMP (chemical mechanical polishing) apparatus. Polishing is carried out by moving the semiconductor wafer held by a polish head over a polish cloth. The polish head is provided with an annular retainer ring on its outer peripheral portion for holding the semiconductor wafer.

The polish head typically controls the polish profile by applying a constant pressure on the semiconductor wafer while applying controlled pressure on the retainer ring as well during the polishing process. When high pressure is applied to the retainer ring, the wear of the retainer ring becomes uneven and typically results in an increased clearance between the semiconductor wafer and the retainer ring. As a result, the pressure applied to the retainer ring becomes less effective which makes it difficult to maintain the desired polish profile.

Thus, increasingly high pressure needs to be applied to the retainer ring in order to obtain a polish profile close to the desired profile. However, application of high pressure accelerates the wear of the retainer ring itself.

On the other hand, the increase in the clearance between the semiconductor wafer and the retainer ring can be inhibited by reducing the diametrical width of the retainer ring. However, increasingly high pressure needs to be applied to the retainer ring in order to obtain a polish profile close to the desired profile since the area of contact between the semiconductor wafer and the polish cloth is reduced. This significantly reduces the life of the retainer ring.

DESCRIPTION

In one embodiment, a retainer ring configured to be attachable, at a first side thereof, to a polish head of a polish apparatus configured to polish a polish object by depressing the polish object against a polish pad is disclosed. The retainer ring is configured to depress the polish pad at a second side thereof. The retainer ring includes a contact surface configured to contact the polish pad. The contact surface is configured to apply depressing force on the polish pad. The depressing force is directed from a polish head side and is applied so as to be centered on an imaginary circle of pressure center having a radius falling substantially in a middle of an inner radius of the retainer ring and an outer radius of the retainer ring. An area of the contact surface is greater in a first region inside the circle of pressure center than in a second region outside the circle of pressure center.

Embodiments are described herein with reference to the accompanying drawings. The drawings are schematic and are not necessarily consistent with the actual relation between thickness and planar dimensions as well as the ratio of thicknesses between different layers, etc. Further, directional terms such as up, down, left, and right are used in a relative context with an assumption that the surface, on which circuitry is formed, of the later described semiconductor substrate faces up and thus, do not necessarily correspond to the directions based on gravitational acceleration.

First Embodiment

A description will be given hereinafter on a first embodiment with reference to FIG. 1 to FIG. 8.

Figure 1:
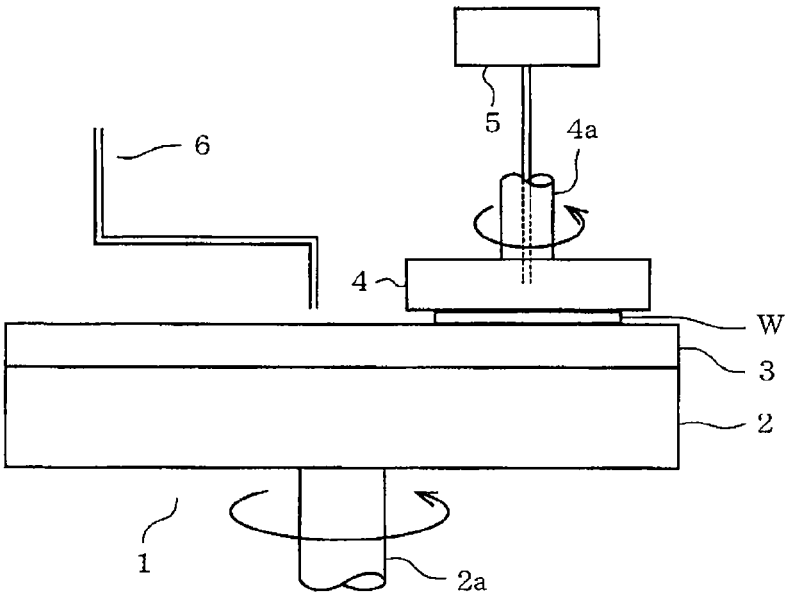
FIG. 1 pertains to the first embodiment and illustrates one example of the overall structure of a polish apparatus.

FIG. 1 schematically illustrates the overall configuration of a polish portion 1 of a CMP (chemical mechanical polishing) apparatus 1 used for example in polishing a 12-inch semiconductor wafer W (having a diameter of approximately 30 cm). The driving of polish portion 1 is controlled by a control unit not shown. Polish portion 1 is provided with a turntable 2. Turntable 2 is configured to receive polish pad 3 on its upper surface and has rotary shaft 2*a* extending downward from its under surface. Turn table 2 is driven in rotation by a motor by way of rotary shaft 2*a*. Polish portion 1 is further provided with an arm and polish head 4 configured to be movable above turn table 2 by the arm. Polish head 4 is driven in rotation with semiconductor wafer W attached to its under surface and the polishing process is carried out on turn table 2. Polish head 4 is moved up and down by way of head shaft 4*a* extending upward from its upper surface. When polishing, polish head 4 is lowered to an elevation to contact polish pad 3. Head shaft 4*a* of polish head 4 is connected via a timing belt to drive mechanism 5 provided with components such as a motor. The rotational drive of head shaft 4*a* is controlled to a predetermined rotation count by the control unit. Nozzle 6 for supplying slurry (polishing liquid) is provided above the upper surface of turn table 2.

Figure 2:
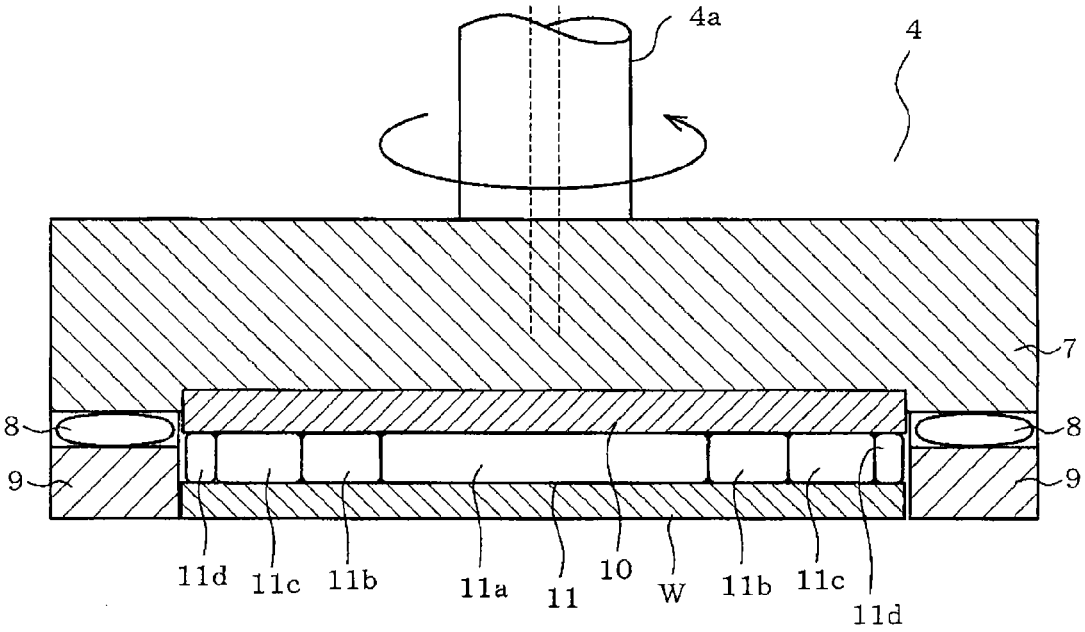
FIG. 2 is one example of vertical cross-sectional side view schematically illustrating a polish head.

FIG. 2 schematically illustrates a vertical cross section of polish head 4. Polish head 4 includes polish head body 7 and retainer ring 9. Body 7 is shaped like a circular disc having a recessed under surface. Retainer ring 9 is attached to the under surface of polish head body 7. Pressure chamber 8 is defined in the outer peripheral portion of the under surface of polish head body 7 so as to be located between polish head body 7 and retainer ring 9. Polish head body 7 is made of a strong and rigid material such as metal, ceramics, or the like. Retainer ring 9 is made of a rigid resin, ceramics, or the like.

Inside the recess of polish head body 7, chucking plate 10 is installed which is configured to be movable up and down while holding semiconductor wafer W. Chucking plate 10 may be made of metal. From the stand point of inhibiting metal contamination and improving end point sensitivity, materials which do not possess conductivity and magnetism may be used. Examples of such materials include poly phenylene sulfide resin (PPS), poly ether ether ketone resin (PEEK), fluoride-based resin, and ceramics for example. Pressure chamber 11 is provided at the under surface of chucking plate 10 for applying pressure on semiconductor wafer W. Pressure chamber 11 is provided with peripheral walls attached to the under surface portion of chucking plate 10 which form four pressure chambers 11*a*, 11*b*, 11*c*, and 11*d* with chucking plate 10. Pressure chambers 11*a* to 11*d* are formed of an elastic film so that pressure can be applied evenly to semiconductor wafer W. For example, the elastic film may be formed of rubber materials having outstanding strength and durability such as ethylene propylene rubber (EPDM), polyurethane rubber (PU), silicon rubber, or the like. Further, the rubber material for forming the elastic film preferably exhibits a hardness (duro) ranging from 20 to 60 for example. Pressure chamber 8 for applying pressure on retainer ring 9 is also formed of similar materials.

Pressure chambers 11*a* to 11*d* are formed concentrically with respect to the central portion of the under surface of chucking plate 10. A round pressure chamber 11*a* is provided around the central portion of under surface of chucking plate 10. Annular pressure chambers 11*b*, 11*c*, and 11*d* are provided adjacent to one another in the outer peripheral portion of pressure chamber 11*a*. A dedicated supply tube is provided to each of pressure chambers 11*a* to 11*d* and to pressure chamber 8 associated with retainer ring 9. The supply tube is capable of supplying pressurized fluid such as air for controlling the pressure applied to each of pressure chambers 11*a* to 11*d* and 8.

Figure 3A:
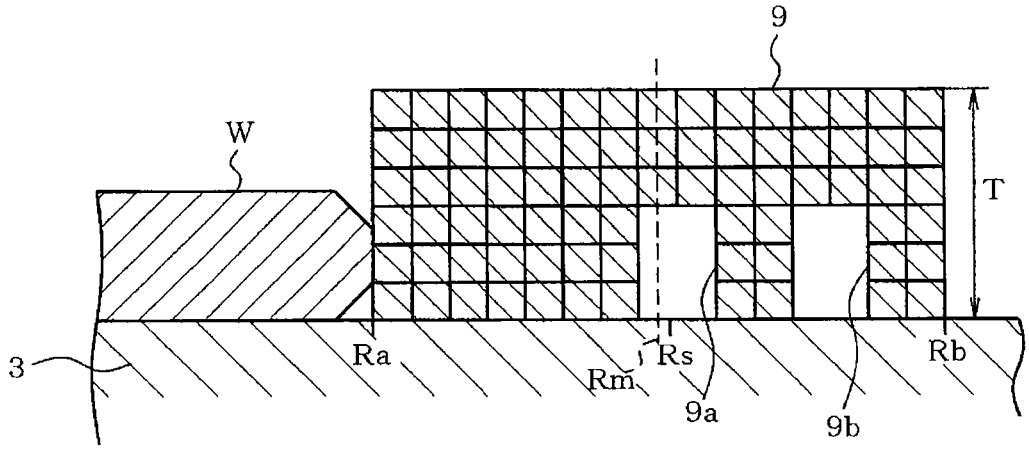
FIG. 3A is one example of a cross-sectional view of a retainer ring.
Figure 3B:
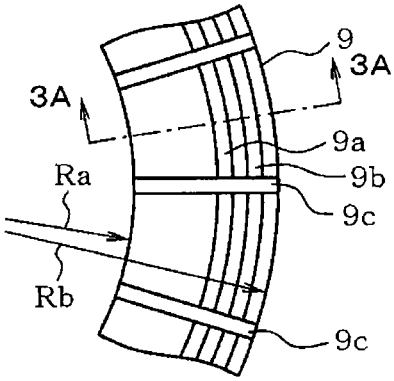
FIG. 3B is one example of a partial plan view of a retainer ring.

FIG. 3A and FIG. 3B illustrate the shape of retainer ring 9 of the first embodiment. FIG. 3A illustrates the cross section of retainer ring 9 taken along the radial (diametrical) direction and FIG. 3B illustrates a plan view of the surface of retainer ring 9 contacting polish pad 3. In FIG. 3A, the lattice drawn with solid lines in the cross-sectional portion of retainer ring 9 are auxiliary lines drawn at equal intervals to provide good understanding of the dimensions of retainer ring 9. Retainer ring 9 is formed in an annular shape having inner radius Ra (150 mm for example), outer radius Rb (165 mm for example), radial width of approximately 15 mm, and thickness T (40 mm for example). Retainer ring 9 accommodates semiconductor wafer W in its inner side so that the outer peripheral surface of semiconductor wafer W contacts its inner surface.

Two concentric grooves 9*a* and 9*b* are formed in the surface of retainer ring 9 (under surface) contacting polish pad 3 so as to be located relatively in the outer peripheral side than the inner peripheral side. Retainer ring 9 is configured so that the area of contact with polish pad 3 is relatively greater in its inner peripheral side than its outer peripheral side. In the first embodiment, grooves 9*a* and 9*b* are each configured to have a radial width of 2 mm and are centered on perimeters of concentric circles (having a radius of 158 mm and a radius of 162 mm) passing through a location 8 mm from the inner peripheral end portion of retainer ring 9 and a location 12 mm from the inner peripheral end portion of retainer ring 9, respectively. The surface of retainer ring 9 contacting polish pad 3 is reduced as compared to the conventional structure by the presence of grooves 9*a* and 9*b*; however, area of contact substantially equal to the conventional structure is obtained as a whole. Thus, the desired polish profile can be realized with the load of retainer ring 9 being configured substantially equal to the load of the conventional structure. Further, grooves 9*c* oriented in the radial direction are disposed circumferentially at a predetermined angular interval. Groove 9*c* serves as a passageway of slurry. Groove 9*c* may or may not be provided depending upon the polish conditions.

In the first embodiment, the area of the surface of retainer ring 9 contacting polish pad 3 is configured to be greater in the in the inner peripheral side as compared to the outer peripheral side by the formation of grooves 9*a* and 9*b*. This is done in order to prevent unevenness in the amount of wear of the inner peripheral side and the outer peripheral side of retainer ring 9. The inventors have found that the inner peripheral contact surface tend to wear in greater amount compared to the outer peripheral contact surface in a conventional retainer ring in which concentric grooves are not formed in the surface contacting the polish pad. As a result, the thickness of the retainer ring becomes thinner in the inner peripheral side as compared to the outer peripheral side and thereby causing the pressure applied to the polish pad by the inner peripheral side of the retainer ring to be reduced.

This is presumed to originate from the tendency of the retainer ring to expand toward the outer peripheral side by being pushed outward through contact with polish pad. It is also presumed to be attributable to the retainer ring being depressed toward the polish pad by the pressure being applied at its widthwise central portion by the pressure chamber disposed above the retainer ring.

Thus, when the pressure applied by pressure chamber 8 is taken into consideration, it is presumed to be effective in inhibiting uneven wear of retainer ring 9 by increasing the contact area located in the inner peripheral side of retainer ring 9 with respect to the center of pressure received by retainer ring 9. Grooves 9*a* and 9*b* are provided in retainer ring 9 of the first embodiment for the above described reasons. As described above, the area of contact of retainer ring 9 with polish head 3 is greater in the inner peripheral side of retainer ring 9 than in the outer peripheral side of retainer ring 9. That is, when an imaginary circle (hereinafter referred to as a circle of pressure center circle or a pressure center circle) having radius Rm located substantially at the midpoint of inner diameter Ra and outer diameter Rb and having a perimeter defined by the collection of the center of pressure applied from polish head 4 side to polish pad 3 side is drawn, the area of contact retainer ring 9 located in the inner side of the circle is greater than the area of contact of retainer ring 9 located in the outer side of the circle.

Figure 4A:
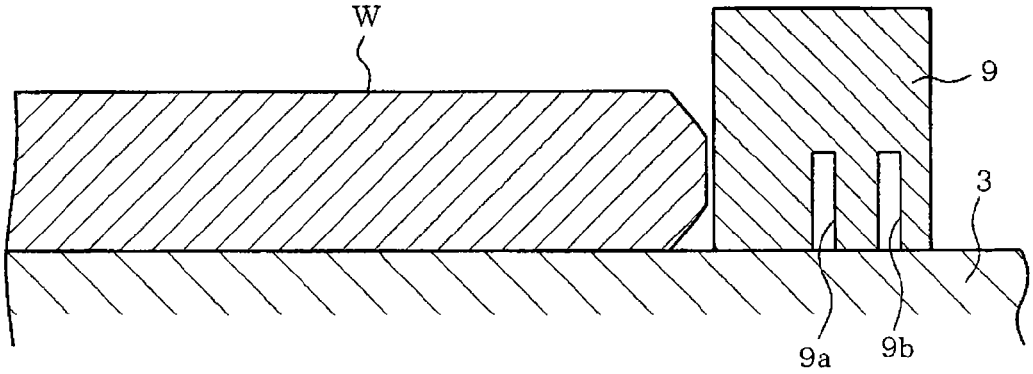
FIG. 4A is one example of a cross-sectional view of an unused retainer ring.

Next, a description will be given on the polish process of the first embodiment with reference to FIG. 4 to FIG. 6. Semiconductor wafer W being processed as described below is prepared as the polish object. As illustrated in FIG. 5A, the processing of semiconductor wafer W begins by forming silicon nitride film (SiN) 101 serving as a first insulating film above silicon substrate 100. Silicon nitride film is formed in a thickness of 15 nm for example.

Then, trench 102 (having a depth of 200 nm for example) is formed which is followed by formation of NSG (non-doped silicate glass) film 103 serving as a second insulating film into trench 102 and above silicon nitride film 101. NSG film 103 is formed in a thickness of 350 nm for example. Silicon nitride film 101 and NSG film 103 are used as the first insulating film and the second insulating film, respectively in this example. However, one or more types of insulating materials selected from the group of TEOS (tetraethoxysilane) oxide film, silicon nitride film (SiN), hydrogen containing silicon carbide film (SiCH), nitrogen containing silicon carbide film (SiCN), carbon containing silicon oxide film (SiOC), hydrocarbon containing silicon oxide film (SiOCH), and polycrystalline silicon film (Poly-Si).

Next, as NSG film 103 above silicon nitride film 101 is removed by CMP. In carrying out the CMP, retainer ring 9 of the first embodiment is attached to polish apparatus 1. In the above described polish apparatus 1, slurry containing ceria (cerium oxide: $CeO_2$) as abrasive grains is supplied from slurry dispensing nozzle 6. In this example, polishing is carried out by dripping a slurry containing 1 wt % of ceria having a grain diameter of 100 nm at a predetermined flow.

The polish conditions include: polish load of 400 gf/cm$^2$, retainer ring load of 440 gf/cm$^2$, polish head rotation speed of 100 rpm, and turn table rotation speed of 105 rpm for example. The removable of NSG film 103 is detected by table current value (TCM: table current monitor). The completion of polish process can be detected since the table current value measured during the polishing of NSG film 103 varies from the table current value measured when silicon nitride film 101 is exposed as the result of NSG film 103 being polished removed.

Figure 5A:
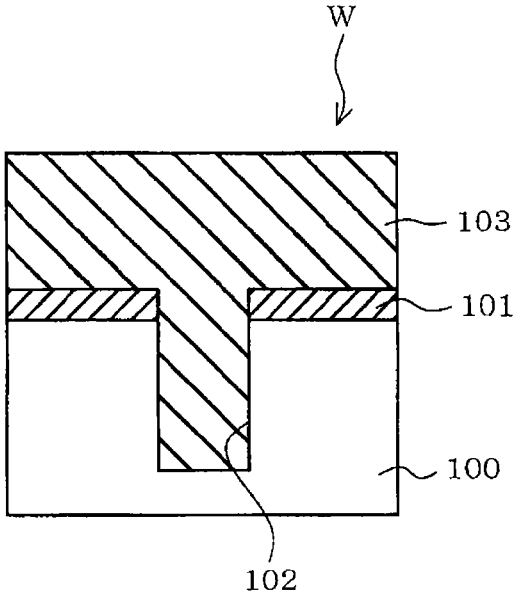
FIG. 5A is one example of a cross-sectional view illustrating the polish object before the polish process.
Figure 5B:
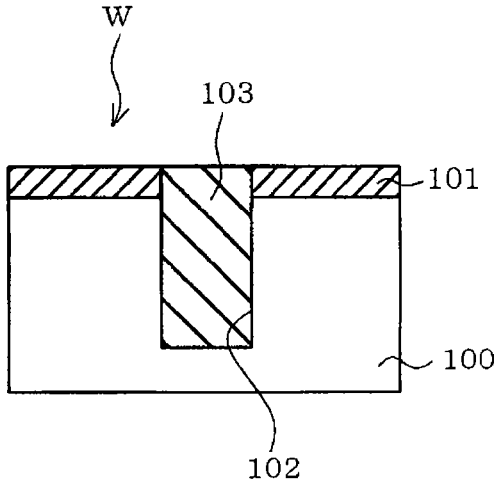
FIG. 5B is one example of a cross-sectional view illustrating the polish object after the polish process.

As a result, it is possible to polish NSG film 103 so that NSG film 103 remains in trench 102 of semiconductor wafer W as illustrated in FIG. 5B. When the conventional retainer ring is used, excessive polishing or insufficient polishing may occur locally and not entirely even when the completion of polishing process is detected based on the table current value. Silicon nitride film 101 is polished and thus, thinned in the excessively polished state, whereas NSG film 103 remains above silicon nitride film 101 in the insufficiently polished state.

Next, a description will be given on the polish process carried out using retainer ring 9. During the polish process, the peripheral portion of semiconductor wafer W is placed in contact with the inner peripheral surface of retainer ring 9. When retainer ring 9 is new or close to the unused state, the cross section of retainer ring 9 is substantially rectangular as illustrated in FIG. 4A. In this state, the portion of the surface of retainer ring 9 contacting polish pad 3 located in the innermost peripheral side is substantially in the same position as the inner peripheral surface of retainer ring 9 and the outer periphery of semiconductor wafer W.

Figure 4B:
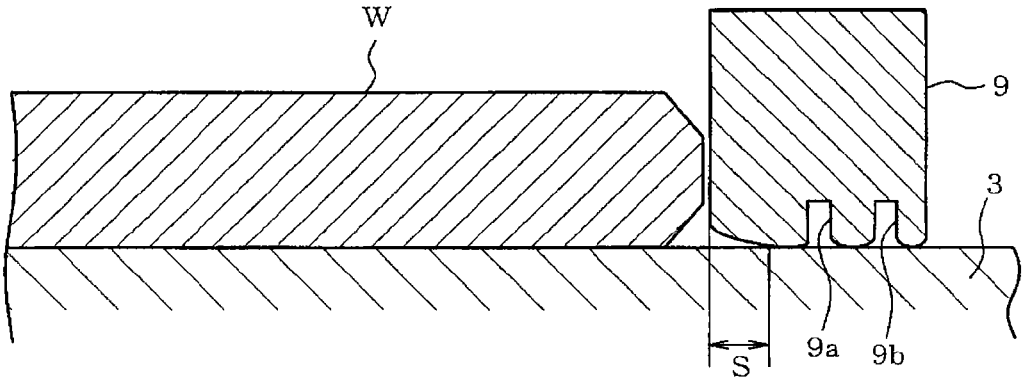
FIG. 4B is one example of a cross-sectional view of a heavily used retainer ring.

Then, after retainer ring 9 is heavily used for increased number of polish times, the surfaces of retainer ring 9 contacting polish pad 3 is worn into a rounded shape with grooves 9*a* and 9*b* serving as boundaries between the rounded surfaces illustrated in FIG. 4B. By providing grooves 9*a* and 9*b*, it is possible to reduce the distance between the innermost peripheral surface of retainer ring 9 to the location of contact with polish pad 3 (distance S to the point of operation). As a result, it is possible to prevent the increase of the clearance (gap) between retainer ring 9 and semiconductor wafer W. Thus, it is possible to inhibit the excessive polishing of the outer peripheral portion of semiconductor wafer W.

Figure 4C:
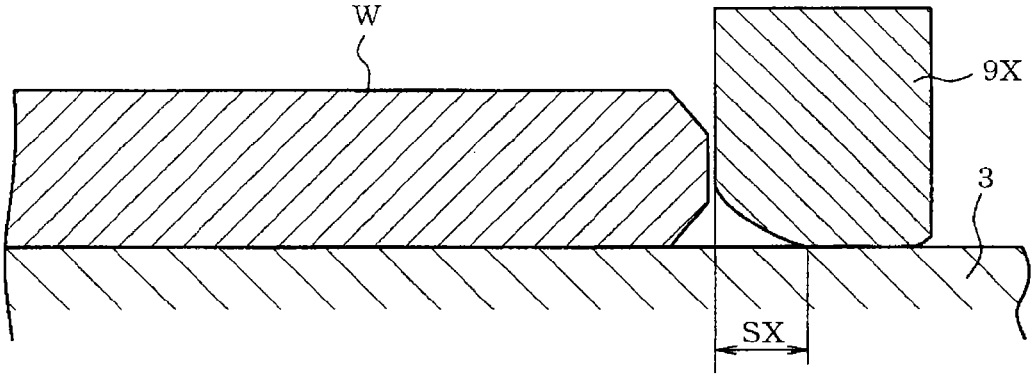
FIG. 4C is one comparative example of a cross-sectional view of a heavily used retainer ring without grooves.

For comparison, the wear of the retainer ring will be described through an example of retainer ring 9X which is not provided with grooves 9*a* and 9*b*. FIG. 4C illustrates a cross section of heavily used retainer ring 9X free of grooves 9*a* and 9*b*. As illustrated, the distance between the innermost peripheral surface of retainer ring 9X to the location of contact with polish pad 3 (distance SX to the point of operation) is greater as compared to the state illustrated in FIG. 4B when grooves are not provided and the clearance between retainer ring 9 and semiconductor wafer W is increased. As can be understood from the comparison with retainer ring 9X free of grooves 9*a* and 9*b*, it is possible to inhibit excessive polishing of the outer peripheral portion of semiconductor wafer W by using retainer ring 9 of the first embodiment.

Figure 6:
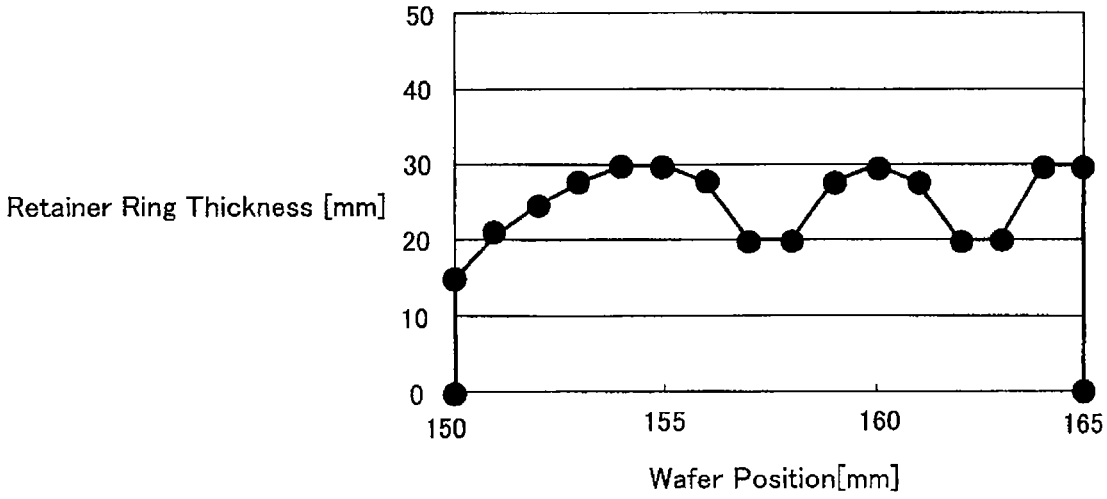
FIG. 6 is a chart indicating one example of a profile of the cross-section of the retainer ring.

The chart in FIG. 6 indicates the profile of the cross section of a heavily used retainer ring 9. It can be understood from the chart that wear is substantially even throughout the structure as a large amount of wear is observed near grooves 9*a* and 9*b* in addition to the inner peripheral side of retainer ring 9.

Further, the load is not increased in the polish process using retainer ring 9 and thus, the speed of wear also remains unchanged. It is thus, possible to prevent retainer ring 9 from being less durable as compared to the conventional retainer ring. The widths and locations of grooves 9*a* and 9*b* of retainer ring 9 of the first embodiment are not limited to those illustrated in FIG. 3A and FIG. 3B, but may be modified in order to obtain similar effects.

In the first embodiment, the contact area of retainer ring 9 in the outer peripheral side has been reduced by providing grooves 9*a* and 9*b* to retainer ring 9. Thus, it is possible to execute the polish process with good controllability of the polish amount (removal amount) of the polish object which, in this example, is semiconductor wafer W. Hence, it is possible to evenly polish the entirety of semiconductor wafer W, including the outer peripheral portions which may have imperfect shots, over a long period time even retainer ring 9 is heavily used. As a result, in addition to achieving improved productivity, it is possible to address problems such as dissolution of metal caused by local permeation of chemical liquid at outer peripheral portions of the wafer where films are delaminated or protection films are removed by excessive polishing.

<Comparision of the Effects of the First Embodiment with Results of Comparative Experiments>

Next, a brief description will be given on how the above described retainer ring 9 was obtained. The inventors have measured the transition in the shape of the retainer ring as it wears over repetitive use. The result of measurement conducted by the inventors on the retainer ring used conventionally and in the present embodiment during a CMP process revealed that the removal amount varies at the peripheral portion of semiconductor wafer W as the amount of wear of the retainer ring increases over use.

Figure 7A:
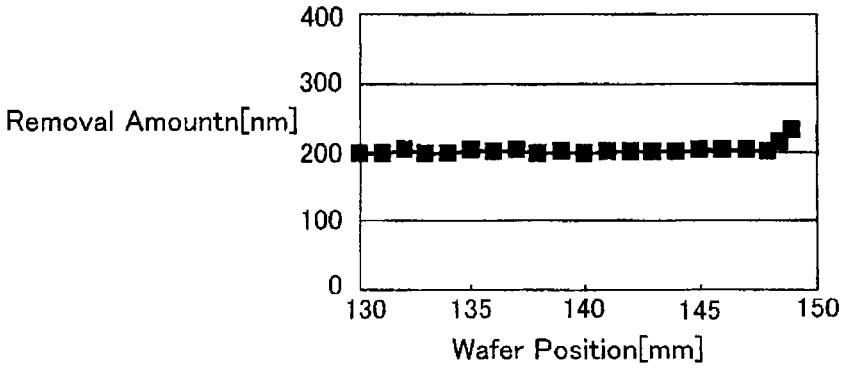
FIG. 7A is a comparative chart indicating the amount of peripheral portion of the semiconductor wafer polished by a conventional unused retainer ring.
Figure 7B:
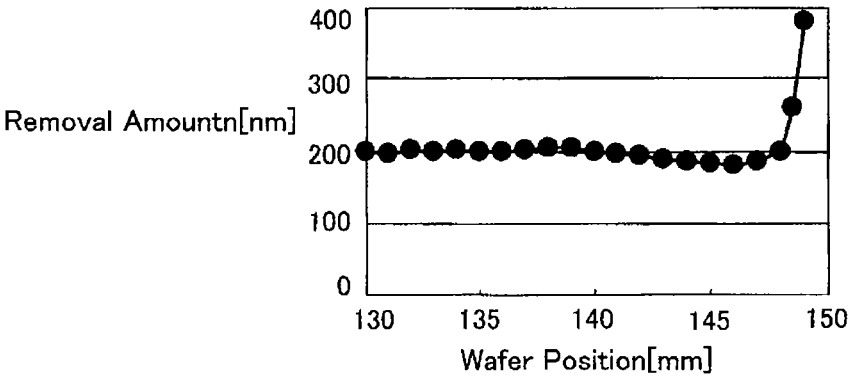
FIG. 7B is a chart indicating the amount of peripheral portion of the semiconductor wafer polished by a heavily used retainer ring.

FIG. 7A indicates the profile of the removal amount in a region of a semiconductor wafer (radius 150 mm) ranging within 20 mm in the radial direction from the outer peripheral portion of the wafer (Wafer Position 130 mm to 150 mm) after the wafer has been polished by 200 nm with a new (unused) conventional retainer ring attached to a polish head. The results indicate that the semiconductor wafer is etched substantially evenly to its outer peripheral portion. FIG. 7B, on the other hand, indicates the profile of the removal amount when polished with a heavily used (used to polish 3000 semiconductor wafers for example) retainer ring attached to a polish head. The results indicate that the removal amount in a region approximately 2 mm inward in the radial direction (near 148 mm) from the outermost periphery is approximately double (approximately 400 nm) the removal amount of approximately 200 nm in a region approximately 10 mm inward in the radial direction (near 140 mm) from the outer peripheral portion.

Figure 8A:
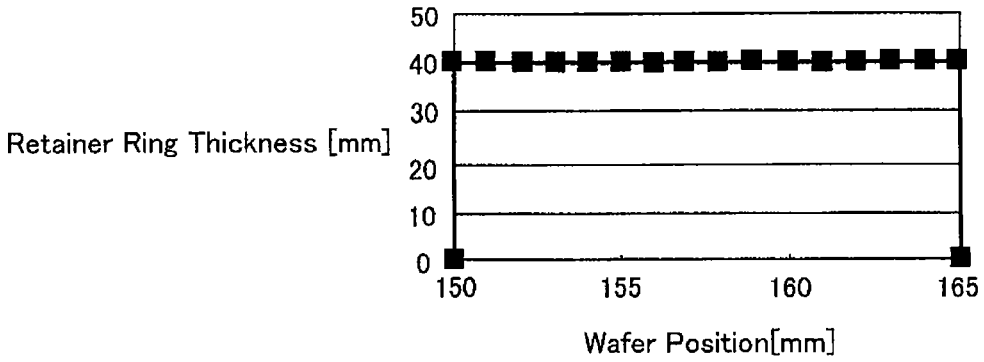
FIG. 8A is a comparative chart indicating one example of a profile of the cross-section of a conventional unused retainer ring.
Figure 8B:
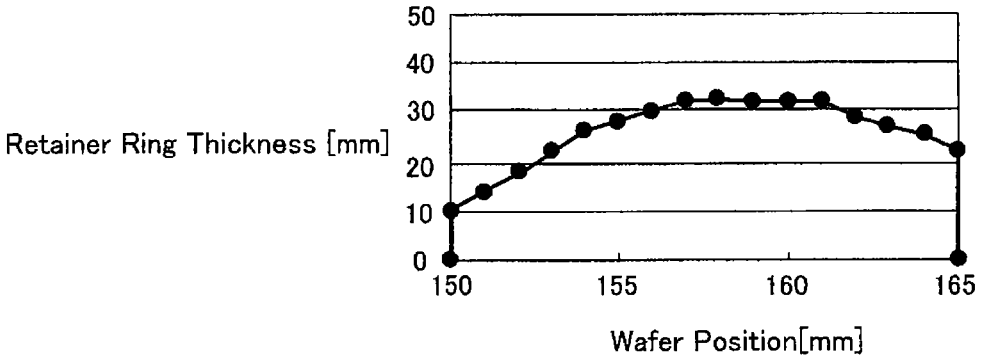
FIG. 8B is a chart indicating one example of a profile of the cross-section of a heavily used retainer ring.

FIG. 8A and FIG. 8B each indicate the profile of the cross-sectional shape of a conventional retainer ring. FIG. 8A indicates the profile of the cross-sectional shape of a new (unused) retainer ring. According to FIG. 8A, the thickness of the retainer ring is 40 mm and the width in the radial direction is 15 mm when measured from the outermost location of semiconductor wafer W so as to span from wafer position 150 mm to wafer position 165 mm. FIG. 8B indicates the profile of the cross-sectional shape of a heavily used retainer ring indicated in FIG. 7B. According to FIG. 8B, the retainer ring is worn significantly in the semiconductor wafer side (inner peripheral side) and thus, the distance from the inner peripheral surface in contact with the semiconductor wafer to the operation point contacting the polish pad is equal to or greater than 10 mm (ranging from Wafer Position 150 mm to 160 mm). The profile was re-evaluated by increasing the load of the retainer ring to twice or more; however, there was hardly any improvement in the profile.

In attempt to address the significant wear of the inner peripheral side of the retainer ring, the inventors modified the width of the retainer ring to 5 mm. As a result, unevenness in the wear of in the inner peripheral side and the wear outer peripheral side was reduced. However, when the modified retainer ring is used, it is required to approximately double the retainer ring load in order to obtain the polish profile achievable by the conventional retainer ring. When the retainer ring load is increased to such magnitude, the wear speed of the retainer ring is increased by approximately four times thereby significantly reducing the life of the retainer ring.

Given such results, retainer ring 9 of the first embodiment is configured so that the area of contact with polish pad 3 is greater in the inner side of the center of pressure applied from pressure chamber 8 side to polish pad 3 side than in the outer side. As a result, it is possible polish the polish object evenly over a long period of time.

Second Embodiment

Figure 9:
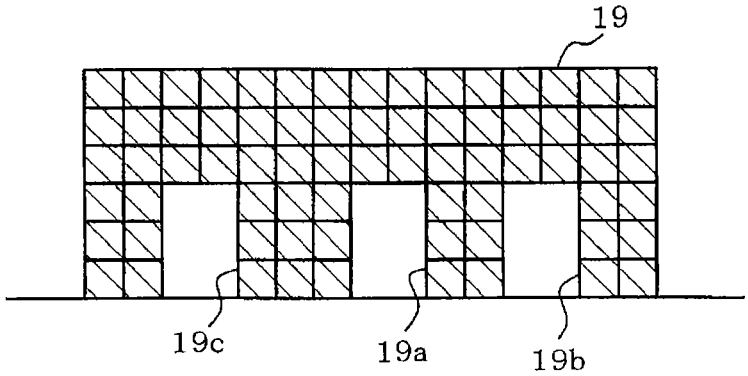
FIG. 9 pertains to a second embodiment and is one example of a cross-sectional view of the retainer ring.

FIG. 9 illustrates a second embodiment. The second embodiment differs from the first embodiment in that retainer ring 19 and a single-layer polish pad 3 are used in the polish process as illustrated in FIG. 9.

In the second embodiment, retainer ring 19 is provided with grooves 19*a* and 19*b* similar to grooves 9*a* and 9*b* of retainer ring 9 of the first embodiment. Retainer ring 19 is additionally provided with groove 19*c* concentric with grooves 19*a* and 19*b* in its inner peripheral side. The distance (length) of the contact surface extending from the inner peripheral side (more specifically, inner peripheral surface) of retainer ring 19 to groove 19*c* is made short so that even a gradual slope is not produced by the wear resulting from the polish process. The relation between the contact surfaces of retainer ring 19 for establishing contact with polish pad 3 set forth in the first embodiment is satisfied by reducing the distance between grooves 19*a* and 19*b* which are located in the outer peripheral side as compared to the distance between groove 19*a* and groove 19*c* which is located in the inner peripheral side as illustrated in FIG. 9.

In the second embodiment, pressure adjustment of pressure chamber 11*d* provided inside polish head 4 is effective in controlling the polish profile at the outermost peripheral portion of semiconductor wafer W as was the case in the first embodiment. However, the pressure applied by retainer ring 19 is also important since plunging and rebounding of polish pad 3 also affects the polish profile in actual operation.

The polish properties of a single layer polish pad 3 employed in the second embodiment is described below. For example, in a process in which the outer peripheral portion of the wafer tends to be etched excessively, it is possible to suppress such tendency even when the pressure applied by retainer ring 19 is low (70 gf/cm$^2$). It was further found that polish properties also vary depending upon the status of wear of retainer ring 19. The amount of wear of retainer ring 19 is uneven in the inner peripheral side and the outer peripheral side as was the case in the first embodiment. It is presumed that retainer ring 19 becomes less effective when the distance between the inner peripheral surface of retainer ring 19 and the contact site with polish pad 3 becomes greater and the clearance between retainer ring 19 and semiconductor wafer W consequently become greater. As described above, the use of the single-layer polish pad 3 relies heavily on the polish conditions. Thus, the amount of wear of retainer ring 19 can be suppressed by the use of the single-layer polish pad 3, however; the polish profile of semiconductor wafer W is influenced by the polish conditions.

As the result of employing the above described configuration, it is possible to suppress slanting of the contact surface residing between the inner peripheral side (inner peripheral surface) of retainer ring 19 and groove 19*c* caused by wear in a heavily used retainer ring 19. It is further possible to stabilize the polish profile of semiconductor wafer W including the outer peripheral portion without reducing the life of retainer ring 19.

In the second embodiment described above, it is possible to substantially level the wear amounts of the contact surfaces of the retainer ring by using retainer ring 19 further provided with groove 19*c* in the inner peripheral side thereof even when a single-layer polish pad 3 is used. As a result, it is possible to prevent the wear amount of semiconductor wafer W in the outer peripheral portion from becoming excessive and thereby extend the life of retainer ring 19.

Third Embodiment

Figure 10A:
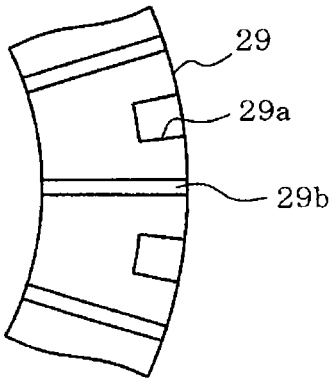
FIG. 10A pertains to a third embodiment and is one example of a partial plan view of one type of retainer ring.
Figure 10B:
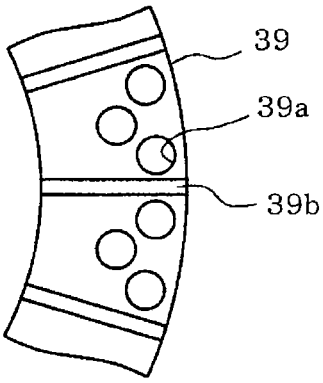
FIG. 10B pertains to the third embodiment and is one example of a partial plan view of another type of retainer ring.

FIG. 10A and FIG. 10B illustrate a third embodiment. In the third embodiment, polish process is carried out by supplying a slurry containing a high-molecular surfactant in addition to the slurry supplied from polish-liquid dispensing nozzle 6 so that semiconductor wafer W can be polished with selectivity to silicon nitride film (SiN).

In the third embodiment, retainer ring 29 is provided with grooves 29*a* and grooves 29*b* as illustrated in FIG. 10A. Groove 29*a* is opened toward the outer peripheral side of retainer ring 29 so as to appear as a notch. Groove 29*b* serves as a slurry passageway and divides retainer ring 29 into circumferential portions. Groove 29*a* is provided in each of the circumferentially divided portions so as to reside on a perimeter of an imaginary circle concentric with retainer ring 29 and thus, is aligned in the circumferential direction with respect to one another. There are instances where the wear of the retainer ring cannot be sufficiently evened out depending upon the polish conditions when a retainer ring having grooves such as those described in retainer ring 9 of the first embodiment and retainer ring 19 of the second embodiment are used. Retainer ring 29 of the third embodiment described above is used in such cases.

By providing rectangular grooves 29*a* in the outer peripheral portion of retainer ring 29, it is possible to satisfy the condition pertaining to the area of contact with polish pad 3 in which the contact area in the inner peripheral side of retainer ring 29 is greater than the contact area in the outer peripheral side of retainer ring 29.

The above described retainer ring 29 was adopted as the result of research carried out by the inventors in which polish properties were studied in detail when a highly selective slurry of the third embodiment is used. The research revealed that especially in a process in which the outer peripheral portion of the wafer tends to be etched excessively, it is possible to suppress such tendency even when the pressure applied by the retainer ring is high (440 $gf/cm^2$ for example). It was further found, again, that polish properties also vary depending upon the status of wear of the retainer ring.

Thus, the effectiveness of the retainer ring is reduced when the wear of the retainer ring becomes uneven and clearance from semiconductor wafer W is increased (distance to the point of operation is increased) as was the case in the first and the second embodiments. This leads to a failure in inhibiting the outer peripheral portion of the polish object (semiconductor wafer W) from being excessively etched. Retainer ring 29 of the third embodiment is configured to suppress wear in the inner peripheral side caused by repetitive polishing.

In the third embodiment described above, wear of retainer ring 29 progresses from grooves 29*a* (edge portions of grooves 29*a*) as polish process is repeated. As a result, it is possible to improve the balance of wear of retainer ring 29 as a whole and thereby stabilize the polish profile of the polish object (semiconductor wafer W) including its outer peripheral portion without reducing the life of retainer ring 29.

Retainer ring 29 illustrated in FIG. 10A may be replaced by retainer ring 39 illustrated in FIG. 10B. Retainer ring 39 is provided with circular recesses 39*a* disposed in the outer peripheral side. In another embodiment, recesses 39*a* may be replaced by through holes. Retainer ring 39 is divided into circumferential portions by groove 39*b* serving as a slurry passageway. Three recesses 39*a* for example are provided in each of the circumferentially divided portions so as to reside on perimeters of imaginary circles concentric with retainer ring 39 and thus, are aligned in the circumferential direction with respect to one another. The circular recess 39*a* may be formed into any other shape.

Fourth Embodiment

Figure 11:
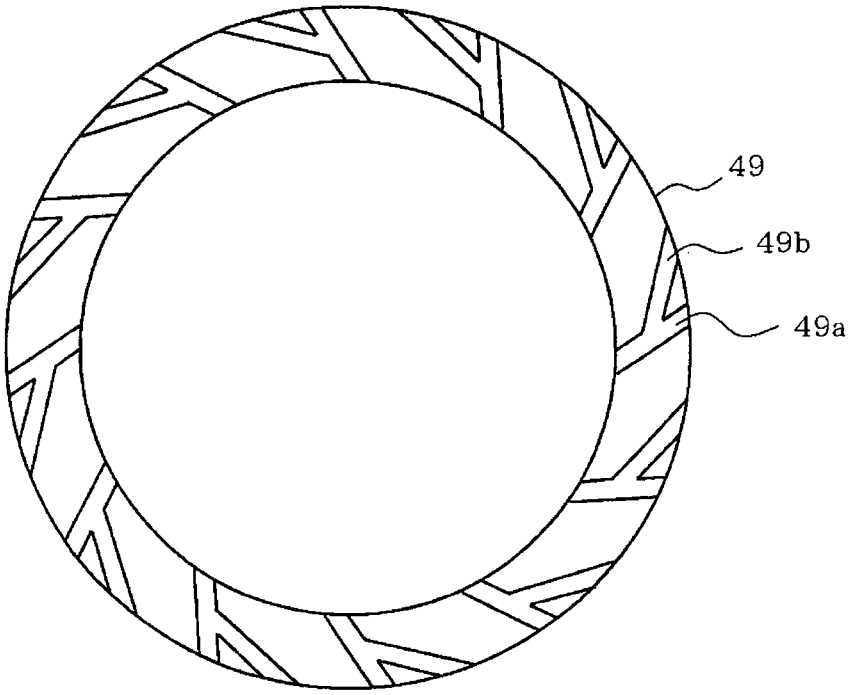
FIG. 11 pertains to a fourth embodiment and is one example of a plan view of the retainer ring.

FIG. 11 illustrate a fourth embodiment. A description will be given hereinafter on the differences from the first embodiment. FIG. 11 is a plan view illustrating the surface on one side of retainer ring 49 contacting polish pad 3. As illustrated in FIG. 11, retainer ring 49 is provided with grooves 49*a* and grooves 49*b*. Groove 49*a* is formed so as to divide the contact surface of retainer ring 49 in the circumferential direction. Further, groove 49*a* is configured to be inclined relative to the radial direction. Groove 49*a* also serves as a slurry passageway. Groove 49*b* branches off of the midway portion of groove 49*a* and is further inclined relative to the radial direction and extends toward the outer peripheral portion. The above described third embodiment also satisfies the condition pertaining to the area of contact with polish pad 3 in which the contact area in the inner peripheral side of retainer ring 49 is greater than the contact area in the outer peripheral side of retainer ring 49.

Retainer ring 49 being configured as described above achieves the operation and effect similar to those of the first embodiment.

The angle of inclination of grooves 49*a* and 49*b* of retainer ring 49 from the radial direction may be adjusted as required. The width and the number of grooves 49*a* and 49*b* may also be adjusted as required.

Fifth Embodiment

Figure 12A:
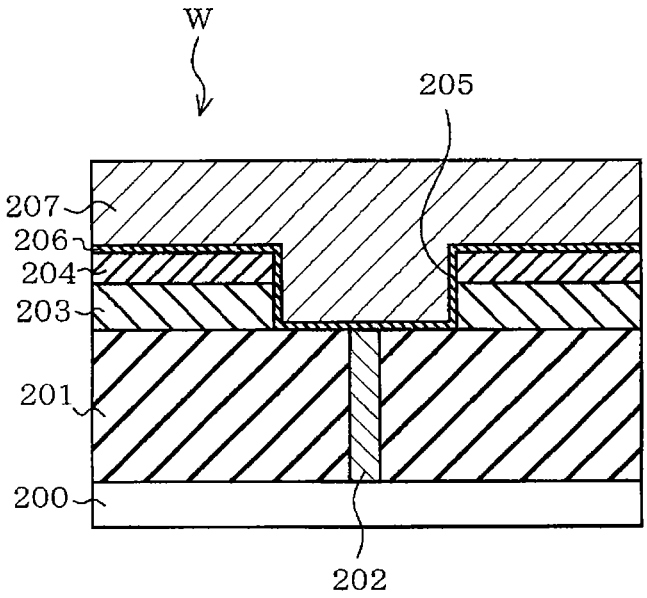
FIG. 12A pertains to a fifth embodiment and is one example of a cross-sectional view of a polish object before the polish process.
Figure 12B:
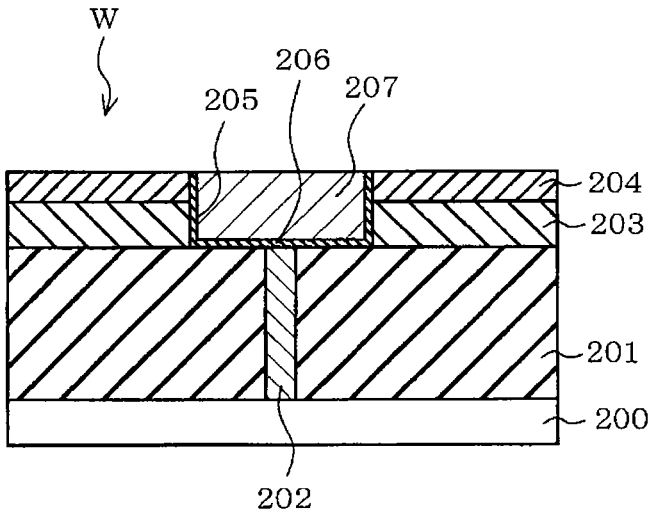
FIG. 12B pertains to the fifth embodiment and is one example of a cross-sectional view of a polish object after the polish process.

FIG. 12A and FIG. 12B illustrate a fifth embodiment. The fifth embodiment is directed to an example of a polish process carried out based on semiconductor wafer W configured as described below. Semiconductor wafer W is polished under the following conditions.

FIG. 12A illustrates a cross section of an upper portion of semiconductor wafer W where semiconductor elements are formed. Semiconductor elements are formed in the upper surface of silicon substrate 200 and first insulating film 201 is formed over the upper surface of silicon substrate 200 and the formed semiconductor elements. Tungsten (W) plug 202 is formed in the up and down direction through first insulating film 201. A stack of insulating films including second insulating film 203 and third insulating film 204 are formed one over the other above the upper surface of first insulating film 201. Second insulating film 203 may be formed of a low dielectric constant insulating material having a relative dielectric constant less than 2.5. Second insulating film 203 may be formed for example by selecting at least one type of film selected from a group consisting of films having siloxane framework such as polysiloxane, hydrogen silsesquioxane, polymethylsiloxane, and polymethylsilsesquioxane; films having organic resin as a primarily component such as polyarylene ether, polybenzoxazole, and polybenzocyclobutene; and porous films such as a porous silica film. In this example, 80 nm of low-dielectric constant film formed by a black diamond (registered trademark) technology is used as second insulating film 203.

Third insulating film 204 serves as a cap insulating film and may be formed of an insulating material having a relative dielectric constant greater than second insulating film 203. Third insulating film 204 may be formed of one type of insulating material having a relative dielectric constant of 2.5 or greater selected from a group consisting of TEOS (tetraethoxysilane), SiC, SiCH, SiCN, SiOC, and SiOCH. In this example, 160 nm of SiOC was used for example as third insulating film 204.

Trench 205 having a thickness of 240 nm for example is formed through the stack of insulating films including second insulating film 203 and third insulating film 204. As a result, the upper surface of first insulating film 201 and the upper surface of tungsten plug 202 are exposed. Titanium (Ti) film 206 serving as a barrier metal is formed above third insulating film 204 and inside trench 205 in a thickness of 10 nm for example. Copper (Cu) film 207 is formed above the upper surface of titanium film 206 so as to fill trench 205. In this example, copper film 207 is formed in a thickness of 1200 nm.

Next, a description will be given on the polish process performed for semiconductor wafer W configured as described above. A CMP process is performed using the polish apparatus configured as described in the first embodiment. In this example, semiconductor wafer W processed as described above is placed on polish head 4 of the polish apparatus. Slurry is supplied from polish liquid dispensing nozzle 6. The slurry includes for example an ammonium persulphate (1.5 wt %) used as an oxidant, quinaldic acid (0.3 wt %) used as complexing agent, oxalic acid (0.1 wt %) used as an organic acid, grains of colloidal silica (0.6 wt %), and polyoxyethylene alkylether (0.05 wt %) used as a surfactant. The above described slurry is controlled to pH 9 by pure water and potassium hydroxide. The flow rate of slurry supplied to polish pad 3 is approximately 300 ml/min.

The parameters of polish conditions include polish load of 300 gf/cm$^2$, rotational speed of polish head 4 of 105 rpm, the rotation speed of turn table 2 at 100 rpm, and the polish time is determined when polish removal of copper (Cu) is detected by ECM (detection of the presence and absence of Cu by eddy-current method).

The polish process is carried out under the above described conditions and finished as illustrated in FIG. 12B. As illustrated in FIG. 12B, semiconductor wafer W is processed so that third insulating film 204 is exposed by removing copper (Cu) film 207 and titanium (Ti) film 206 by polishing and trench 205 is filled with copper film 207 via titanium film 206.

Because concentric grooves 9*a* and 9*b* are provided in the concentric retainer rings 9 and 19 as discussed in the first embodiment and the second embodiment, it is possible to significantly reduce the amount of deposits developing on retainer rings 9 and 19 since grooves 9*a* and 9*b* facilitate the flow of slurry and the discharging of polish waste being produced as the polishing progresses. Further, it is possible to supply slurry to semiconductor wafer W more efficiently by using retainer rings 9 and 19 which in turn improves the polish speed.

The retainer ring wears unevenly in the secondary polishing known as Tu-CMP (touch up CMP) performed after the primary polishing is completed, though not as much as the wear observed in Ox-CMP (oxide film CMP). Though not discussed in detail, it is possible to improve unevenness in the wear of the retainer ring during Tu-CMP by using retainer rings 9 and 19.

In a Cu/Tu-CMP, known as a series processing, in which Cu-CMP (copper CMP) is followed by touch up CMP, it has become possible to reduce scratching of retainer rings 9 and 19 by the reduced polish waste produced during Cu-CMP and improved unevenness of the wear of the retainer ring during Tu-CMP. As a result, it has become possible to extend the life of the retainer rings 9 and 19. The foregoing advantages are achieved by specifying the widths, locations, etc. of grooves 9*a*, 9*b*, 19*a*, 19*b*, and 19*c* formed in retainer rings 9 and 19 which may be modified as required so long as the conditions pertaining to the relation of contact areas are satisfied.

Though wear was hardly observed in conventional retainer rings, there were instances where the polish waste formed a complex with Cu (copper) and produced deposits in the grooves of the retainer ring. The deposits detached from the grooves of the retainer ring during the polish process caused scratches on the polish object.

The fifth embodiment described above also achieves the operation and effect similar to those of the first embodiment.

Sixth Embodiment

Figure 13A:
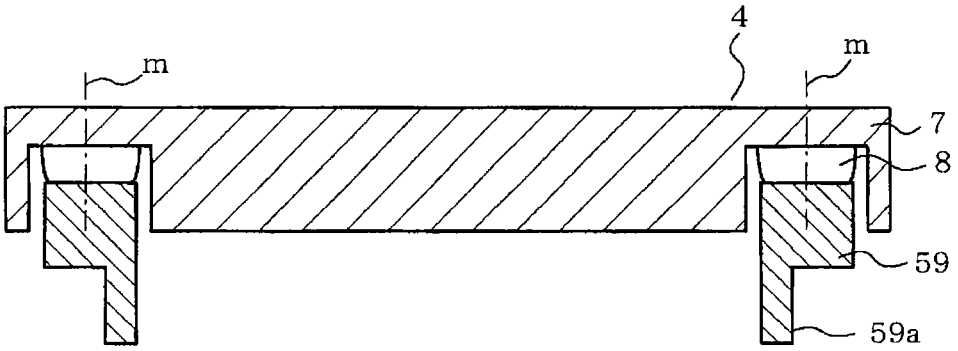
FIG. 13A pertains to a sixth embodiment, and is one example of a cross-sectional view of the retainer ring.
Figure 13B:
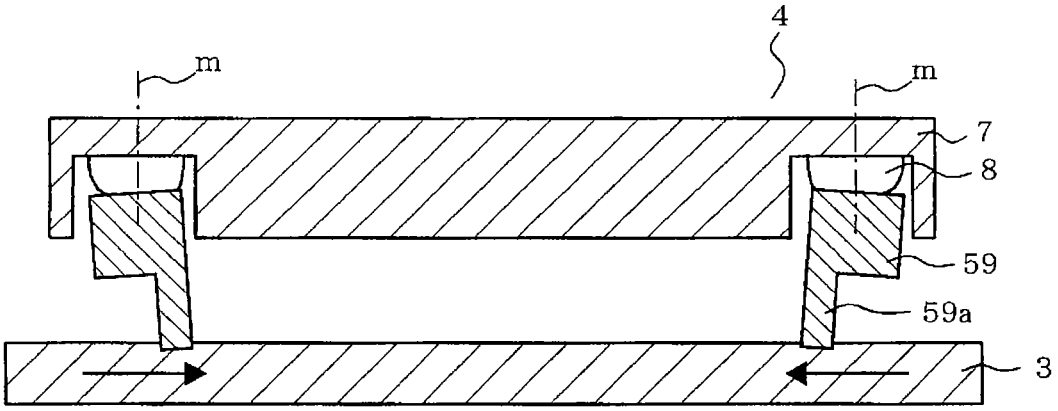
FIG. 13B pertains to the sixth embodiment, and is one example of a cross-sectional view of the retainer ring in use.
Figure 14:
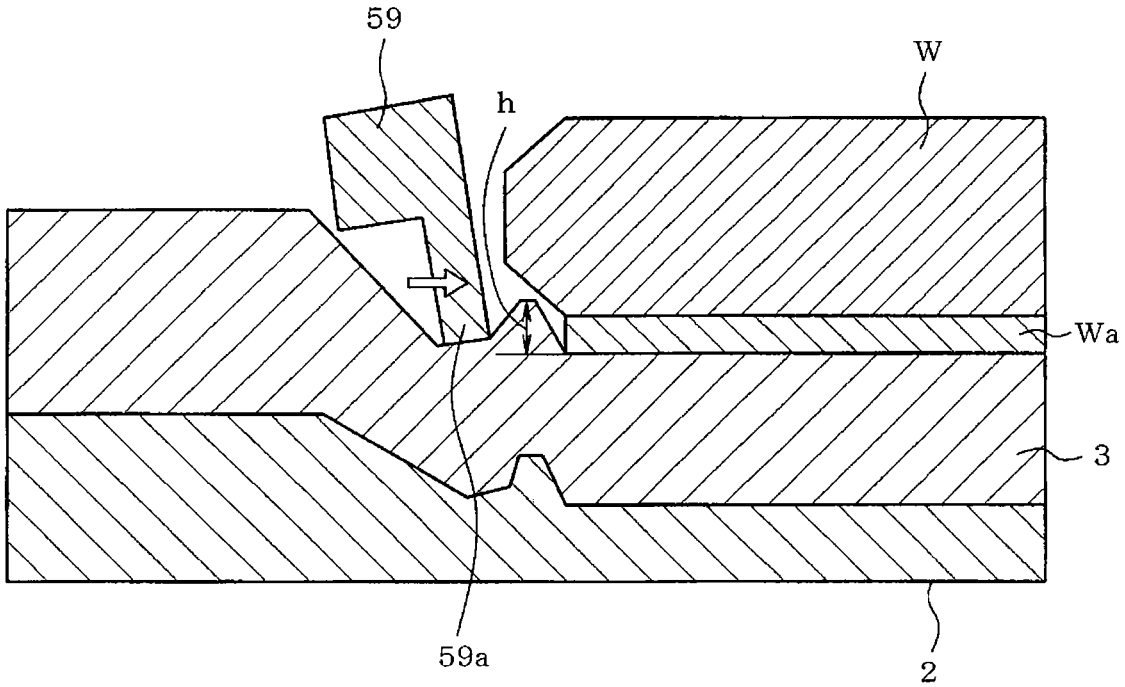
FIG. 14 is one example of a descriptive view illustrating the retainer ring and the polish pad in operation.

FIG. 13 and FIG. 14 illustrate a sixth embodiment. The differences from the first embodiment are described hereinafter. FIG. 13A and FIG. 13B each illustrate a vertical cross-sectional side surface of polish head body 7. In FIG. 13A and FIG. 13B, chucking plate 10, membrane 11, and semiconductor wafer W are not illustrated. As illustrated in FIG. 13A, contact surface portion 59*a* of retainer ring 59 for contacting polish pad 3 is provided only in the inner peripheral side of retainer ring 59. Thus, contact surface portion 59*a* is located in the inner peripheral side of imaginary line m indicating the center of pressure applied toward polish pad 3 by pressure chamber 8.

As the result of the above described structure, contact surface portion 59*a* of retainer ring 59 is inwardly displaced as illustrated in FIG. 13B when retainer ring 59 is in use. Retainer ring 59 is depressed in the direction of line m indicating the center of pressure as retainer ring 59 receives pressure directed toward polish pad 3 from pressure chamber 8 disposed above it. As contact surface portion 59*a* of retainer ring 59 is located in the inner peripheral side relative to the downwardly depressing force applied to retainer ring 59, contact surface portion 59*a* receives force directed from the outer peripheral side to the inner peripheral side so as to be displaced toward the inner peripheral side.

Under such state, the depressing force exerted by pressure chamber 8 causes contact surface portion 59*a* of retainer ring 59 to be displaced toward semiconductor wafer W as illustrated in FIG. 14. As a result, contact pressure applied to the outer peripheral side of contact surface portion 59*a* of retainer ring 59 tend to be greater than the contact pressure applied to the inner peripheral side of contact surface portion 59*a* of retainer ring to reduce wear of the inner peripheral side. In FIG. 14, the magnitude of displacement of the components is exaggerated for the convenience of explaining the slanting of retainer ring 59 and the difference in the rebound heights.

Further, it is possible to reduce the spacing between contact surface portion 59*a* of retainer ring 59 and semiconductor wafer W and reduce rebound height h of polish pad 3. Because element portion Wa of semiconductor W is less affected by the rebound, it is possible to improve polish performance in the outer peripheral portion of semiconductor wafer W as well.

When using the conventional retainer ring, the entire width of the retainer ring serves as the contact surface portion and thus, the contact surface portion tend to spread out in the outer peripheral side by the depressing force exerted from pressure chamber 8. As a result, the spacing between the contact surface portion of the retainer ring and semiconductor wafer W is increased and leads to the tendency of high rebounds. Thus, polishing of element portion Wa at the outer peripheral portion of semiconductor wafer W tend to be uneven by rebound when conventional retainer ring is used.

In the sixth embodiment described above, the outer edge of retainer ring 59 is stepped to form contact surface portion 59*a* which is located inward relative to the center of pressure received by retainer ring 59. Thus, retainer ring 59 contacts polish pad 3 only at contact surface portion 59*a* located inward relative to the center of pressure received by retainer ring 59. As a result, an inwardly oriented force is exerted on retainer ring 59 to cause contact surface portion 59*a* to be displaced inward by slanting. This reduces the pressure-free region as well as the distance between retainer ring 59 and semiconductor wafer W. Thus, it is possible to inhibit excessive polishing at the outer peripheral portion of semiconductor wafer W by rebounding of polish pad 3.

Seventh Embodiment

Figure 15A:
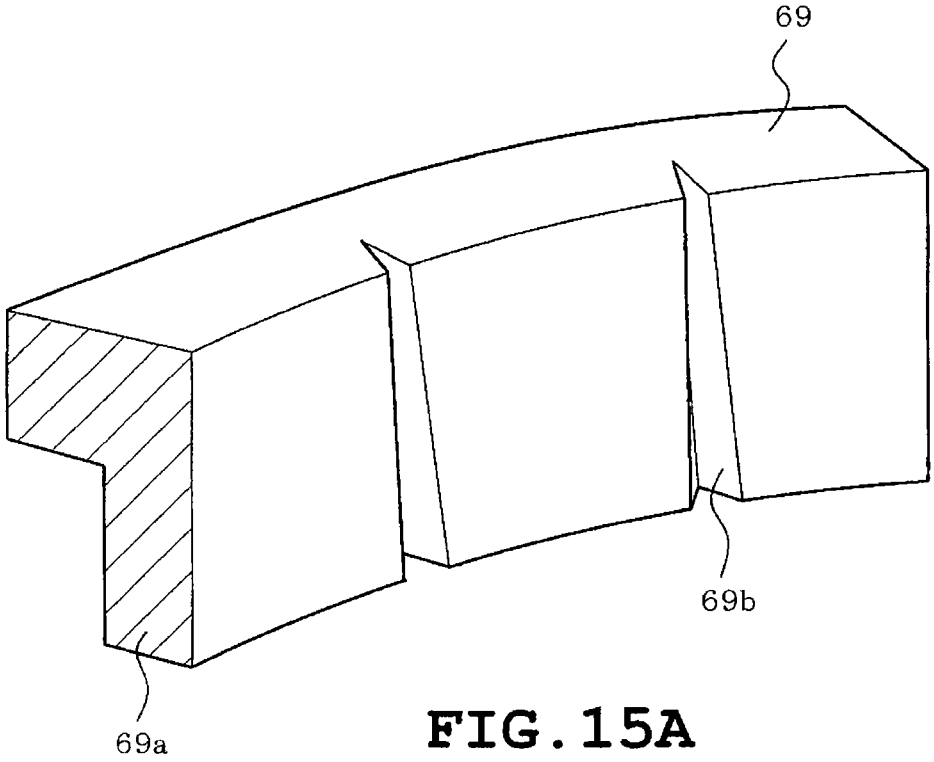
FIG. 15A pertains to a seventh embodiment and is one example of a partial perspective view of a retainer ring.
Figure 15B:
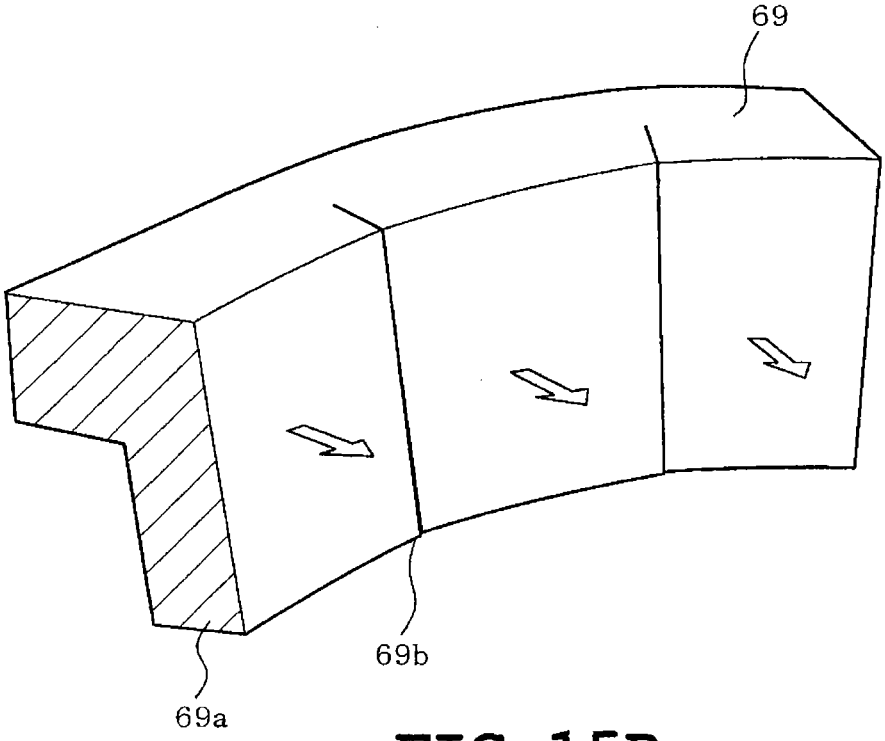
FIG. 15B pertains to the seventh embodiment and is one example of a partial perspective view of a retainer ring in use.
Figure 16:
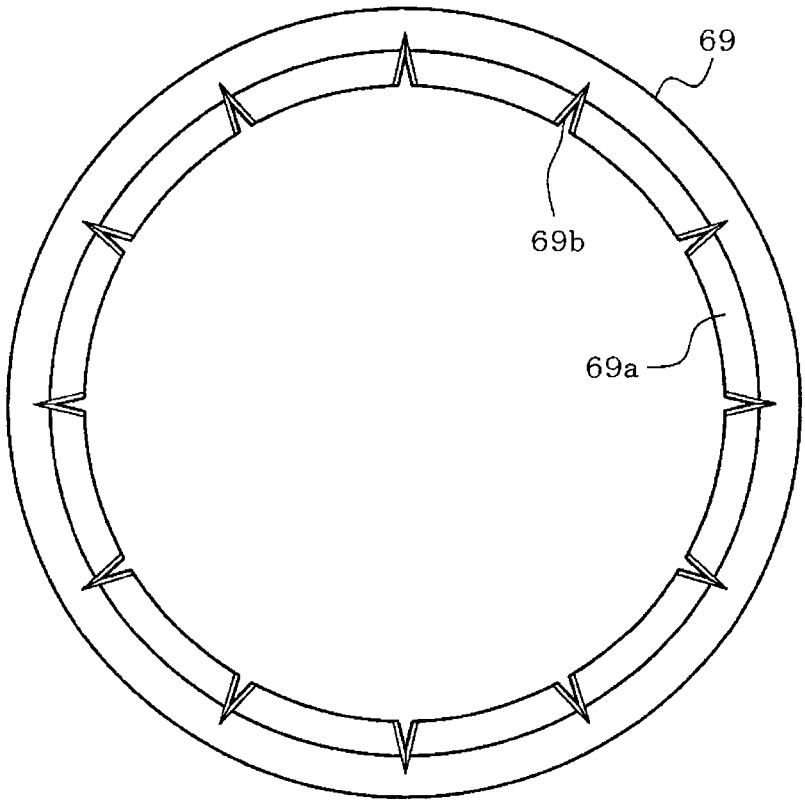
FIG. 16 is one example of a plan view of the retainer ring.

FIG. 15A, FIG. 15B and FIG. 16 illustrate a seventh embodiment.

FIG. 15A and FIG. 15B each partially illustrate the exterior look of retainer ring 69. FIG. 16 is a plan view of one side of retainer ring 69 configured to contact polish pad 3. In the seventh embodiment, retainer ring 69 is stepped so that contact surface portion 69*a* is provided in the inner peripheral side of retainer ring 69. Slits 69*b* are provided circumferentially on the inner peripheral surface of retainer ring 69 at predetermined space interval.

Slits 69*b* of retainer ring 69 are shaped like a wedge (like a reversed letter V) spreading toward contact surface portion 69*a* from the pressure chamber 8 side. Further, the width of slit 69*b* is the widest at the inner peripheral side and becomes narrower in the diametric direction toward the outer peripheral side like a wedge (like a letter V) as illustrated in FIG. 16. Slit 69*b* appears as a relatively small wedge when viewed from one side of retainer ring 69 facing pressure chamber 8 and appears as a relatively large wedge when viewed from the other side of retainer ring 69 facing polish pad 3. Thus, contact surface portion 69*a* of retainer ring 69 is circumferentially divided by slits 69*b* while rest of retainer ring located in pressure chamber 8 side is structurally integral.

Because slits 69*b* are formed on retainer ring 69 as described above, slanting of contact surface portion 69*a* is facilitated when receiving pressure to slant (be displaced) toward the inner peripheral side during the polish process as was the case in the sixth embodiment. Thus, when contact surface portion 69*a* slants (becomes displaced) toward the inner peripheral side as illustrated in FIG. 15B, slits 69*b* are narrowed as illustrated in FIG. 15B.

The seventh embodiment described above also achieves the operation and effect similar to those of the sixth embodiment. By providing slits 69*b* on the inner peripheral surface of retainer ring 69, contact surface portion 69*a* slants (is displaced) more easily as compared to the sixth embodiment. The inward slanting (displacement) of retainer ring 69 during the polish process reduces the distance between retainer ring 69 and the edge of semiconductor wafer W. Thus, it is possible to inhibit excessive polishing at the outer peripheral portion of semiconductor wafer W by rebounding of polish pad 3.

Eight Embodiment

Figure 17:
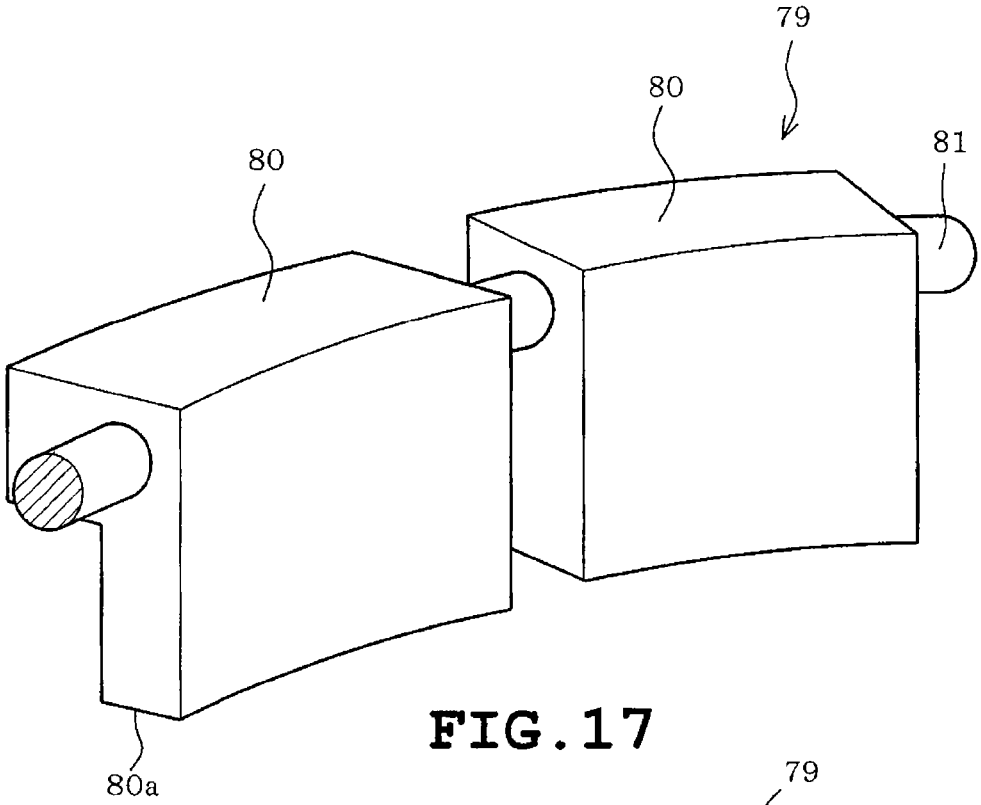
FIG. 17 pertains to an eight embodiment and is one example of a partial perspective view of the retainer ring.
Figure 18:
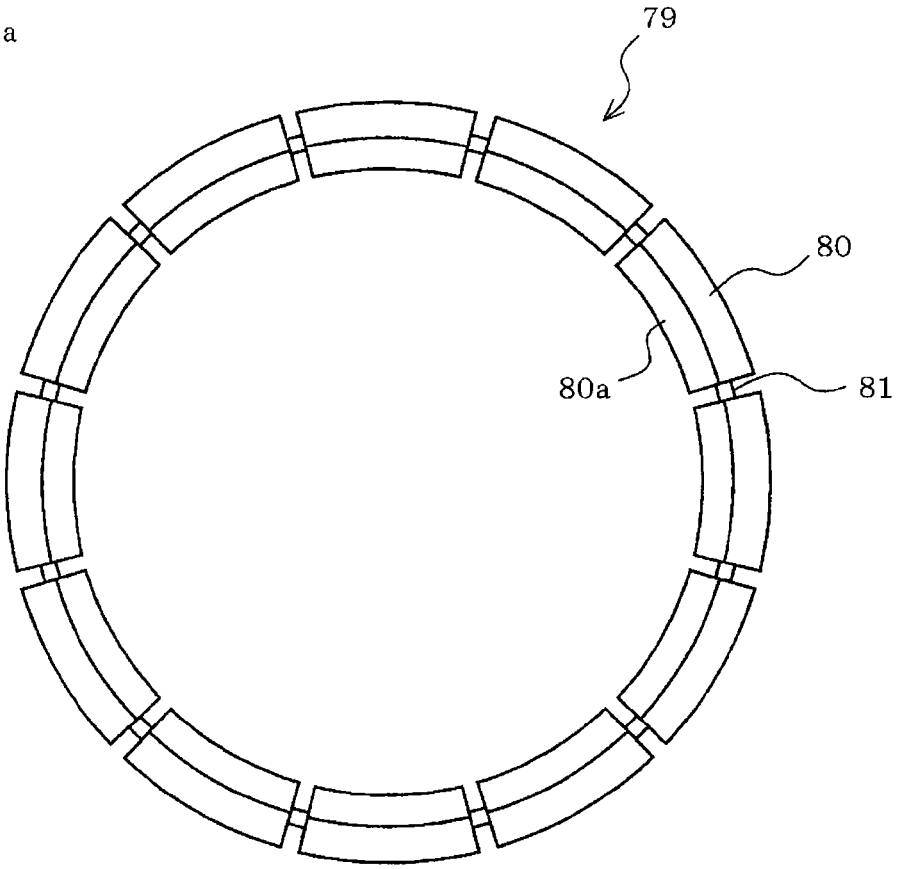
FIG. 18 is one example of a plan view of the retainer ring.

FIG. 17 and FIG. 18 illustrate an eight embodiment. The differences from the seventh embodiment are described hereinafter.

FIG. 17 partially illustrates the exterior look of retainer ring 79. FIG. 18 is a plan view of one side of retainer ring 79 configured to contact polish pad 3. In the eighth embodiment, retainer ring 79 comprises circumferentially divided ring parts 80 linked together by linking ring 81. Each of ring parts 80 are stepped so that contact surface portion 80*a* is provided in the inner peripheral side of retainer ring 79.

Ring parts 80 are linked together so as to be spaced from one another. Ring parts 80 are further configured to be capable of being displaced in a rotating manner about the axis of the link ring 81. Ring parts 80 may be fixed to link ring 81 and thus, be rotated by elastic deformation or may be supported rotatably by link ring 81.

The above described structure of retainer ring 79 causes retainer ring 79 to receive pressure to slant (be displaced) toward the inner peripheral side during the polish process as was the case in the seventh embodiment. When receiving such pressure, ring parts 80 rotate about the axis of link ring 81 and slant (be displaced) toward the inner peripheral side of retainer ring 79. Ring parts 80 are mounted on link ring 81 with spacing from the adjacent ring parts 80 and thus, are capable of being displaced in the inner peripheral side with rotation without contacting one another.

Thus, the eight embodiment is also capable of facilitating the slanting (displacement) of contact surface portion 80*a* by diving retainer ring 79. The inward slanting (displacement) of retainer ring 79 during the polish process reduces the distance between retainer ring 79 and the outer peripheral portion of semiconductor wafer W. Thus, it is possible to inhibit excessive polishing at the outer peripheral portion of semiconductor wafer W by rebounding of polish pad 3.

In the eighth embodiment, ring parts 80 of retainer ring 79 are linked together with link ring 81. Link ring 81 may be circular or polygonal. Further, link ring 81 may be formed in one or may be a collection of bars being linked into a ring shape.

Other Embodiments

The embodiments described above may be modified as follows.

The embodiments may work independently or may work in combination with one another. The shape and the layout of the grooves of the retainer ring may be modified as required as long as the area of the portion contacting the polish pad is greater in the inner peripheral side of the retainer ring than in the outer peripheral side of the retainer ring.

In some of the foregoing embodiments, two or three concentric grooves were provided on the retainer ring. However, number of such concentric grooves may be one or four or more.

The grooves formed on the retainer ring may take various shapes other than rectangular or circular shapes as long as such grooves are disposed coaxially.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A retainer ring configured to be attachable, at a first side thereof, to a polish head of a polish apparatus configured to polish a polish object by depressing the polish object against a polish pad, the retainer ring configured to depress the polish pad at a second side thereof, the retainer ring comprising:

a contact surface configured to contact the polish pad, the contact surface configured to apply depressing force on the polish pad, the depressing force being directed from a polish head side and being applied so as to be centered on an imaginary circle of pressure center having a radius falling substantially in a middle of an inner radius of the retainer ring and an outer radius of the retainer ring, two or more concentric grooves being provided on the contact surface so that a count of the concentric grooves is greater in a second region outside the circle of pressure center than in a first region inside the circle of pressure center, and an area of the contact surface being greater in the first region inside the circle of pressure center than in the second region outside the circle of pressure center.

2. The retainer ring according to claim 1, wherein the two or more concentric grooves are provided on the contact surface so as to be located in the second region outside the circle of pressure center.

3. The retainer ring according to claim 1, wherein the contact surface has at least one diametrically extending groove configured as a slurry passageway.

4. The apparatus according to claim 3, wherein two or more grooves configured as a slurry passageway are disposed circumferentially at regular angular interval.

5. A polish apparatus comprising a polish head having the retainer ring of claim 1 attached thereto.

6. The retainer ring according to claim 1 comprising a rigid resin or ceramics.

7. A method of polishing a polish object comprising using a polish apparatus comprising a polish head having the retainer ring of claim 1 attached thereto.

8. The method according to claim 7, wherein a slurry used in polishing the polish object includes abrasive grains comprising $CeO_2$.

* * * * *